US009099818B2

(12) United States Patent
Ikeda

(10) Patent No.: US 9,099,818 B2
(45) Date of Patent: Aug. 4, 2015

(54) POWER FEED SOCKET AND CONTACT POINT UNIT USED THEREIN

(71) Applicant: Valeo Japan Co., Ltd., Saitama (JP)

(72) Inventor: Taiichiro Ikeda, Tokyo (JP)

(73) Assignee: Valeo Japan Co., Ltd., Tokyo (JP)

( * ) Notice: Subject to any disclaimer, the term of this patent is extended or adjusted under 35 U.S.C. 154(b) by 0 days.

(21) Appl. No.: 14/363,530

(22) PCT Filed: Nov. 2, 2012

(86) PCT No.: PCT/JP2012/078452
§ 371 (c)(1),
(2) Date: Jun. 6, 2014

(87) PCT Pub. No.: WO2013/088857
PCT Pub. Date: Jun. 20, 2013

(65) Prior Publication Data

US 2014/0322979 A1 Oct. 30, 2014

(30) Foreign Application Priority Data

Dec. 12, 2011 (JP) ..... 2011-270799

(51) Int. Cl.
*H01R 13/688* (2011.01)
*H01R 24/38* (2011.01)
*H01H 37/76* (2006.01)
*H01R 103/00* (2006.01)

(52) U.S. Cl.
CPC ..... *H01R 13/688* (2013.01); *H01H 37/764* (2013.01); *H01R 24/38* (2013.01); *H01R 2103/00* (2013.01)

(58) Field of Classification Search
CPC .... H01R 24/38; H01R 13/688; H01R 103/00; H01H 37/764
USPC ..... 439/620.29, 620.26, 620.28, 439/620.3–620.34, 516, 698, 890
See application file for complete search history.

(56) References Cited

U.S. PATENT DOCUMENTS

| | | | | |
|---|---|---|---|---|
| 5,154,642 | A * | 10/1992 | Chung-Yin | 439/620.29 |
| 5,482,478 | A * | 1/1996 | Liao | 439/620.29 |
| 5,810,622 | A * | 9/1998 | Chang | 439/620.29 |
| 6,190,207 | B1 * | 2/2001 | Wang | 439/620.31 |
| 6,592,406 | B2 * | 7/2003 | Liu | 439/620.31 |
| 6,781,809 | B2 * | 8/2004 | Milanczak | 361/104 |

FOREIGN PATENT DOCUMENTS

JP 02-027337 1/1990

* cited by examiner

*Primary Examiner* — Edwin A. Leon
(74) *Attorney, Agent, or Firm* — Fishman Stewart Yamaguchi PLLC

(57) ABSTRACT

A terminal/fuse assembly is fitted in a cylindrical, metallic inner case. The terminal/fuse assembly disposes a terminal penetrating through a bottom wall, a fuse and a contact point disc that overlap inside a housing composed of a plastic cover plate and a fuse box. The fuse is provided with a fuse body at a tongue piece extending inward from a ring portion in a peripheral edge of an elastic conductive plate. A part of the ring portion is supported in the upward position from the terminal. The contact point disc in contact with the elastic conductive plate at the support portion presses the fuse body downward, and thereby the tongue piece makes contact with the terminal to be conductive from the contact point disc to the terminal.

9 Claims, 11 Drawing Sheets

(A)

(B)

(A)

(B)

POWER FEED SOCKET AND CONTACT POINT UNIT USED THEREIN

BACKGROUND OF THE INVENTION

1. Field of the Invention

The present invention relates to a power feed socket that is installed, for example, in a vehicle and in which a cigarette lighter or a plug of the other electrical product is inserted to supply power thereto, and a contact point unit used in the power feed socket.

2. Description of the Related Art

For example, Japanese Utility Model Examined Publication No. 2-27337 discloses this kind of power feed socket for cigarette lighter, for example.

A case (lighter body) as insert destination of a lighter plug made of metal is molded by deep drawing work to have a bottomed cylindrical shape, and has a through hole in the bottom wall. An insulator is disposed in the case to have the bottom wall therebetween, and an insulator platform, a first terminal, an insulating washer, and a second terminal are disposed in that order outside of the case. A bolt-shaped power feed terminal that is inserted through a hole formed in each member from an inside of the case is tightened from an outside of the case by a nut, thereby assembling the power feed terminal to the case in an insulating state. The first terminal is in an insulating state to the power feed terminal, the second terminal is connected to the power feed terminal, and a fuse is disposed between the second terminal and the first terminal.

A bimetal holding a heater case as an electrode of a lighter plug tip pushed into the case is attached in a head of the power feed terminal, and an electrode of a plug side surface is provided to be in contact with the case. That is, the bimetal is configured as a first contact point to the lighter plug and the case is configured as a second contact point for power feeding. When the heater generates heat to reach a predetermined temperature, the bimetal is deformed to release the lighter plug from a pushing-in position to end the power feeding.

On the other hand, when an abnormal temperature rise occurs due to a failure, the fuse is melted down to break off an electrical connection between the first terminal and the second terminal and stop the power feeding.

It should be noted that in the above structure, when the head of the power feed terminal is configured as the first contact point in a state where the bimetal is removed or the bimetal is attached, the power feeding to the other electrical product is possible.

In the above cigarette lighter, however, for insulating the power feed terminal from the case as the second contact point in the first contact point side of the fuse assembly, components such as the insulator or insulating platform leading to cost increase are required. In addition, the power feed terminal itself has a screw portion formed in a bolt shape, therefore leading to a high increase in cost.

In addition, even except for the bimetal, an elaborate assembly process that the power feed terminal is inserted in a great number of components such as the insulator, the case bottom wall, the insulator platform, the first terminal, the insulating washer and the second terminal, which is then tightened by the nut, is forced to be executed. At this time, for disposing the insulating washer between the first terminal and the second terminal that are jointed by the fuse and therefore have a low degree of freedom in dealing, the power feed terminal is forced to be put through the first terminal and the second terminal individually, particularly causing difficulty with the working process.

That is, the conventional structure has a problem that a high increase in cost occurs both in terms of the components and the assembly process.

SUMMARY OF THE INVENTION

Therefore, the present invention is made in view of the foregoing problems, and an object of the present invention is to provide an power feed socket that is configured with components in a low cost, and is easy in assembly, and a fuse-assembled contact point unit used in the power feed socket.

According to an aspect of the present invention, a contact point unit comprises:

a first housing part made of resin;

a second housing part made of resin that the first housing part overlaps to form a housing;

a first terminal that extends outside of the housing through a bottom wall of the second housing part from an inside of the housing;

a fuse comprising an elastic conductive plate and a fuse body that overlaps over the elastic conductive plate and is melted with overheating, the fuse being disposed in the housing in such a manner that a section of the elastic conductive plate different from an overlapping portion thereof with the fuse body is supported to an upper position separated from the first terminal; and a first contact point that is disposed on the fuse and is pressed from the first housing part, wherein the first housing part is provided with a window for exposing the first contact point in such a manner that an electrode of a plug is contactable with the first contact point, in a coupling state between the first housing part and the second housing part, the first contact point presses the fuse body to elastically deform the elastic conductive plate, which makes contact with the first contact point and the first terminal, thereby causing conduction between the first contact point and the first terminal, and when the fuse body is melted, the elastic conductive plate is elastically restored to be separated from the first terminal, thus causing non-conduction between the first contact point and the first terminal.

Further, according to a power feed socket in a different aspect of the present invention, the contact point unit is fitted in a metallic case, the first contact point is exposed to an inside of the metallic case through a window of an upper wall of the first housing part, and the case is configured as a second contact point.

According to the contact point unit in the aspect of the present invention, the first contact point, the fuse and the first terminal are united, which can be easily treated, can be assembled as one component in the case and can be used in common for many power feed sockets. In addition, since the housing itself has an insulating function, the components such as the insulator and the insulating platform leading to a high increase in cost become unnecessary, and the number of components is made small. As a result, the contact point unit can be realized in a low cost.

According to the power feed socket in the different aspect of the present invention, a power source circuit in the side of the power feed socket is formed only by the metallic case and the contact point unit, and therefore, the configuration is simple. When a plug of an electrical product is inserted in the case, an electrode of the plug tip goes through the window to make contact with the first contact point and an electrode of the plug side surface makes contact with the case, to form a power source circuit to the electrical product. Since the contact point unit is manufactured in a low cost, the power feed socket is also manufactured in a low cost.

In addition, since the fuse of the contact point unit is disposed between the first contact point and the first terminal to be adjacent thereto, even in a case where heat is abnormally generated in the plug side of the electrical product or in a vehicle power source side, the fuse is exposed to the plug side or power source side and at the same time, to the temperature rise thereof to be melted, having high responsiveness.

Particularly, the power feed socket includes a plastic cylindrical outer case and an inner case as the metallic case disposed to overlap over the inside of the outer case, a projection is provided on a connecting wall of the first housing part to project outward, an engagement stopper is provided on an outer surface of a side wall of the second housing part, and the outer case is provided with a notch provided with an engagement edge engaging to the projection in an insert direction of the contact point unit, and an engagement portion to which an engagement stopper is engaged in a dropout direction of the contact point unit, whereby the contact point unit is positioned and fixed to the outer case without using a particular connecting member such as a screw, and the assembly is simple. In addition, since the outer case holds the contact point unit, the inner case acts only as the contact point and may be manufactured with a plate material by press bending work to be formed in a low-cost, simple shape.

BRIEF DESCRIPTION OF THE DRAWINGS

Other objects, features, and advantages of the present invention will become more apparent from the following detailed description made with reference to the accompanying drawings, in which like parts are designated by like reference numbers and in which.

DESCRIPTION OF THE PREFERRED EMBODIMENT

Hereinafter, a power feed socket according to an embodiment in the present invention will be explained with reference to the accompanying drawings by applying the power feed socket installed in a console box or a dashboard panel for a vehicle as an example.

Figure 1:
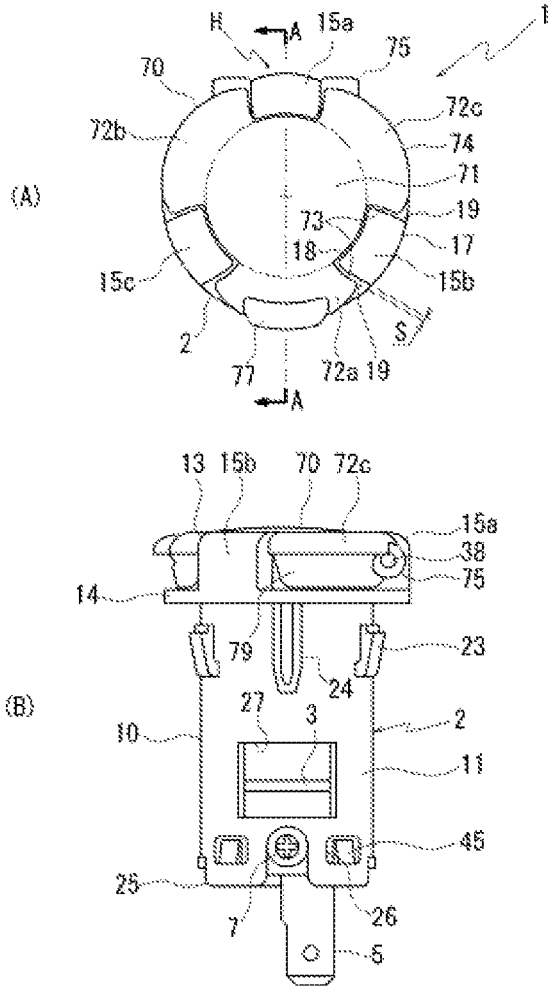
FIG. 1A is a top view showing a power feed socket according to an embodiment in the present invention.
FIG. 1B is a side view showing the power feed socket according to the embodiment.
Figure 2:
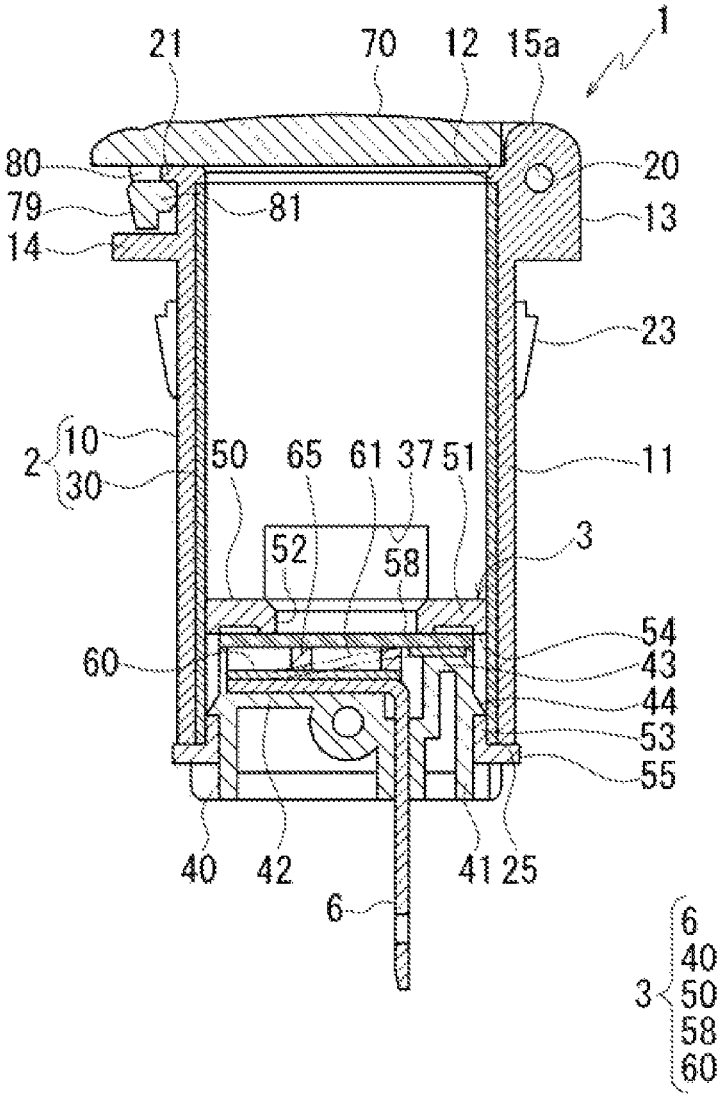
FIG. 2 is an enlarged cross section taken in a direction of arrows A-A in FIG. 1A.

In FIGS. 1A and 1B, and FIG. 2, a power feed socket 1 is configured of a case 2, a terminal/fuse assembly 3 that is attached in the deepest end of the case 2 and in which terminals, a fuse and a contact point are assembled, and a cap 70 attached in an opening end of the case 2.

It should be noted that in the following explanation, an upper/lower relation is shown on condition that the case 2 is opened to the upward direction.

The case 2 is composed of a plastic outer case 10 and a metallic inner case 30. The outer case 10 is primarily formed of a cylindrical portion 11, and a rim portion 13 is formed in the periphery of an opening end of the cylindrical portion 11. The inner case 30 is inserted in the cylindrical portion 11 of the outer case 10 in a pressure contact state, and extends over a substantially entire length from the opening end vicinity to the lower end vicinity of the cylindrical portion 11.

The terminal/fuse assembly 3 is fitted inside a lower end portion of the inner case 30, and is jointly tightened to the inner case 30 together with a terminal 5 extending downward by a screw 7. The inner case 30 is configured as one contact point to an electrode of a plug in an electrical product.

Figure 8:
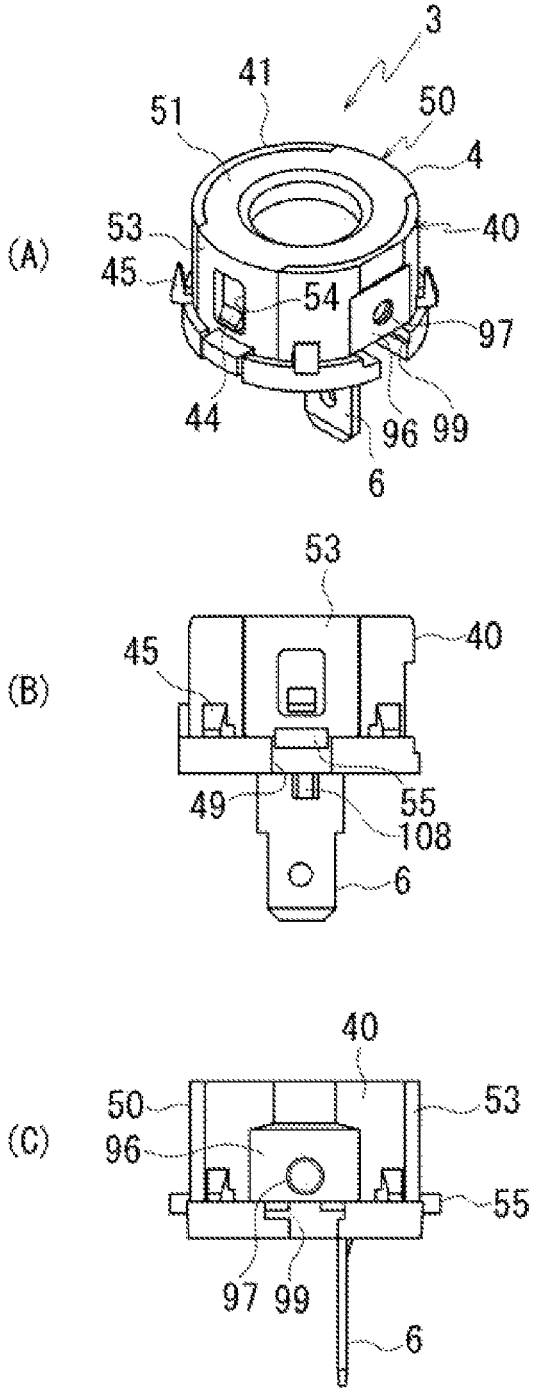
FIG. 8A is a perspective view showing an outside appearance of the terminal/fuse assembly according to the embodiment.
FIG. 8B is a front view showing the terminal/fuse assembly according to the embodiment.
FIG. 8C is a side view showing the terminal/fuse assembly according to the embodiment.

The terminal/fuse assembly 3 is structured such that a plastic fuse box 40 is covered with a plastic cover plate 50 to forma housing 4 (refer to FIG. 8), which supports a terminal 6, and a contact point disc 58 and a fuse 60 are accommodated in the housing 4.

Figure 3:
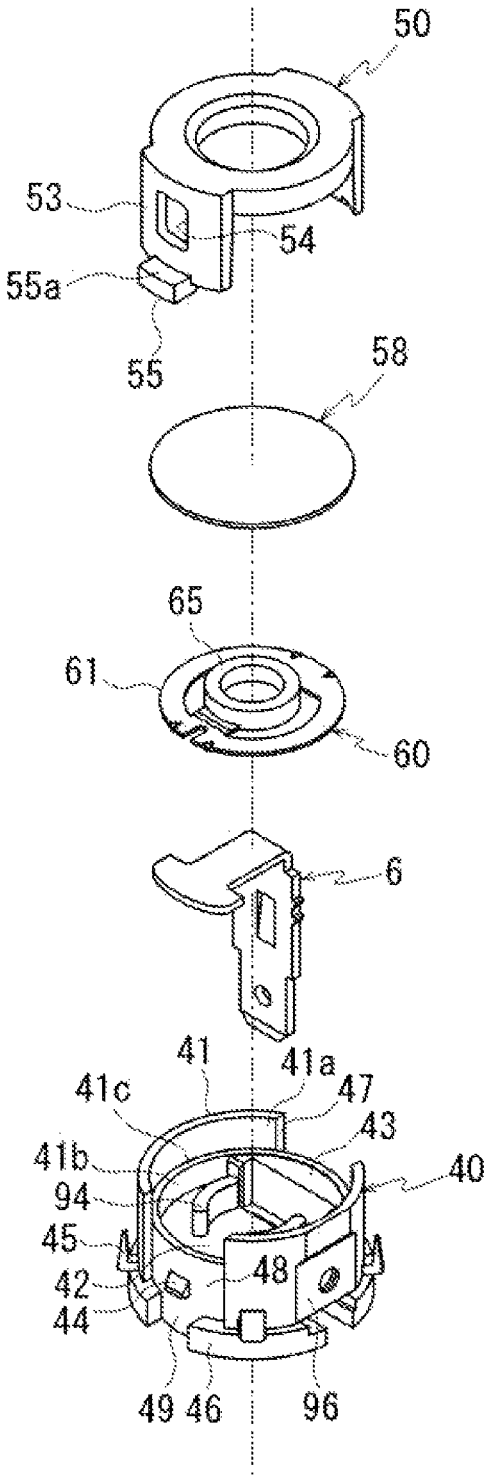
FIG. 3 is an exploded perspective view showing a terminal/fuse assembly according to the embodiment.
Figure 4:
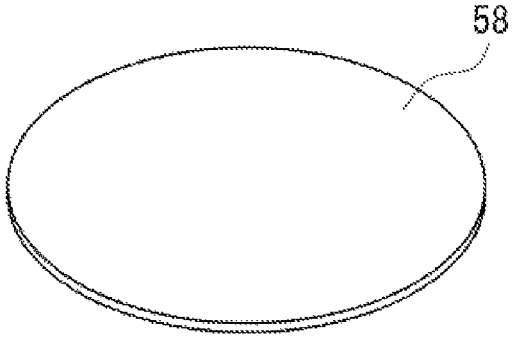
FIG. 4A is an enlarged perspective view showing a contact point disc according to the embodiment.
FIG. 4B is an enlarged perspective view showing a fuse according to the embodiment.
Figure 4:
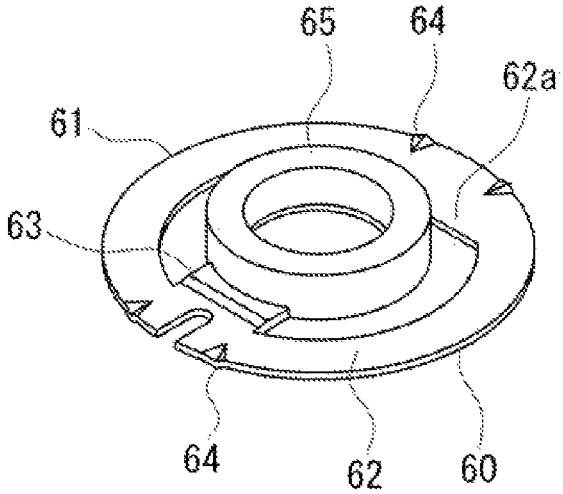

FIG. 3 is an exploded perspective view of the terminal/fuse assembly 3, FIG. 4A is an enlarged perspective view showing the contact point disc 58, and FIG. 4B is an enlarged perspective view showing the fuse 60.

Particularly as shown in FIGS. 4A and 4B, the fuse 60 is provided with an elastic conductive plate 61 composed of a thin plate and a plastic fuse body 65 to be melted due to overheating. The elastic conductive plate 61 comprises a ring portion 62, and a tongue piece 63 extending inward from the ring portion 62 to form a small ring concentric with the ring portion 62, and the fuse body 65 is formed in a short, cylindrical shape and is supported on the small ring of the tongue piece 63. Joint between the elastic conductive plate 61 (tongue piece 63) and the fuse body 65 is made, for example, by outsert molding or adhesion.

The tongue piece 63 is bent at its root, and a section of the tongue piece 63 that supports the fuse body 65 is slightly offset closer to the upward side than the ring portion 62. FIG. 4B shows the curved line alone.

The ring portion 62 of the elastic conductive plate 61 has a thick width part 62*a* provided with a linear inner edge as a section of the ring portion 62 opposing the root of the tongue piece 63 across a ring center.

In addition, press raised portions 64 are formed to be convex upward on an outer peripheral edge of the thick width part 62*a* in the ring portion 62, and press raised portions 64 are formed to be convex downward on an outer peripheral edge in a side of the ring portion 62 connecting to the tongue piece 63.

The contact point disc 58 has a diameter larger than an outer diameter of the elastic conductive plate 61 and is equal to a diameter of an upper wall 51 of the cover plate 50 to be described later.

FIGS. 5A to 5F show a fuse box 40. The fuse box 40 is provided with side walls 41 each having a basic shape of a circular cylinder and enlarged diameter ring portions 46 at a lower end, the enlarged diameter ring portion 46 having an outer diameter matching an inner diameter of the lower end of the cylindrical portion 11 in the outer case 10.

An outer diameter of the side wall 41 upward of the enlarged diameter ring portion 46 is in accordance with an inner diameter of the inner case 30 in pressure contact with the inner surface of the outer case 10, but may be inclined to be narrower in diameter closer to the upward side for facilitation of insert of the side wall 41 in the inner case 30 and for die cutting at molding.

Figure 5:
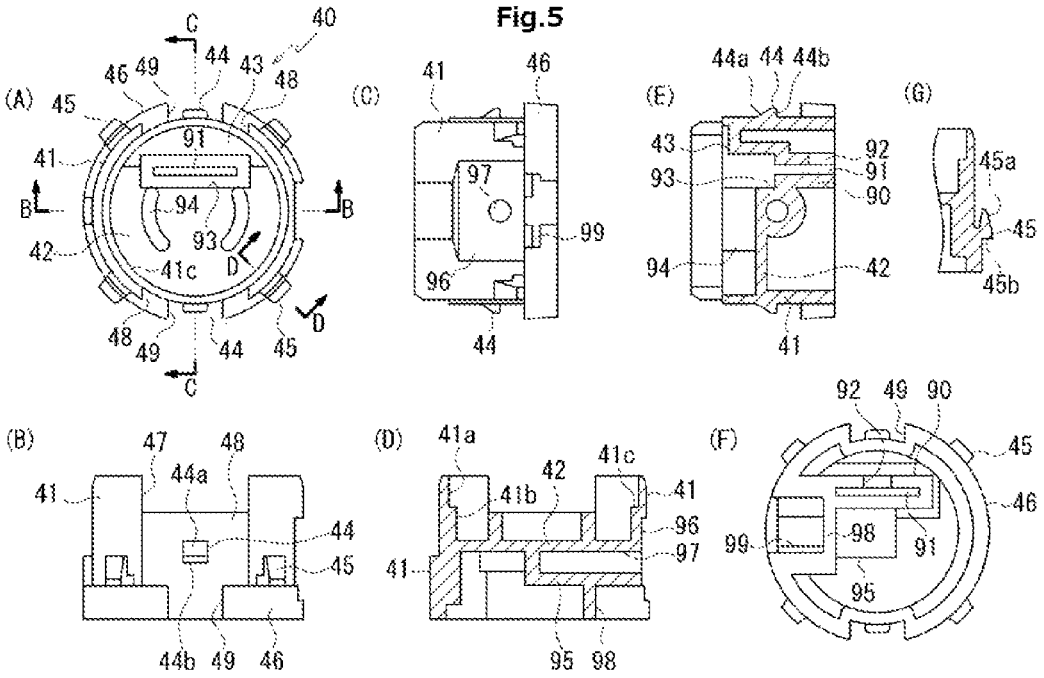
FIG. 5A is a top view showing a fuse box according to the embodiment.
FIG. 5B is a front view showing the fuse box.
FIG. 5C is a side view showing the fuse box.
FIG. 5D is a cross section taken in a direction of arrows B-B in FIG. 5A.
FIG. 5E is a cross section taken in a direction of arrows C-C in FIG. 5A.
FIG. 5F is a back view showing the fuse box.
FIG. 5G is a cross section taken in a direction of arrows D-D in FIG. 5A.
Figure 6:
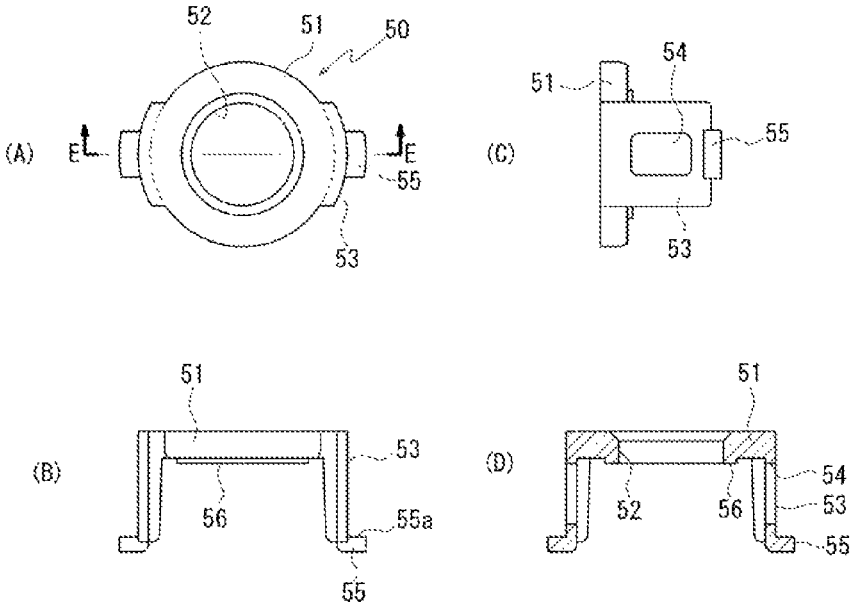
FIG. 6A is a top view showing a cover plate according to the embodiment.
FIG. 6B is a front view showing the cover plate.
FIG. 6C is a side view showing the cover plate.
FIG. 6D is a cross section taken in a direction of arrows E-E in FIG. 6A.

Engagement stoppers 45 are provided in a plurality of locations on the outer surfaces of the side walls 41 in the circumferential direction right above the enlarged diameter ring portions 46 in the axial direction. As shown in FIG. 5G, the engagement stopper 45 is connected to the side wall 41 at a root in the lower end. The engagement stopper 45 has an inner side surface extending upward to have a gap to the outer surface of the side wall 41 to be able to receive the plate thickness of the inner case 30, and an outer side surface formed as an inclined surface 45*a* narrower toward the upper side, and a lower end surface connected to the inclined surface 45*a*, which is formed as an engagement surface 45*b* perpendicular to an axial direction. The gap section becomes an engagement portion to the lower end edge of the inner case 30, and the engagement surface 45*b* becomes an engagement portion to the outer case 10.

Particularly, as shown in FIG. 5D, a bottom wall 42 is disposed inside the side wall 41 in a position approximately one-half as high as the side wall 41. An inner surface of the side wall 41 upward from the bottom wall 42 is divided into a first inner wall portion 41*a* in an axial range corresponding to a thickness of an upper wall 51 of the cover plate 50 and a second inner wall portion 41*b* downward from the first inner wall portion 41*a* in that order from the upper end. A diameter of the first inner wall portion 41*a* corresponds to an outer diameter of the upper wall 51, and a diameter of the second inner wall portion 41*b* corresponds to an outer diameter of the elastic conductive plate 61 of the fuse 60. A boundary between the first inner wall portion 41*a* and the second inner wall portion 41*b* smaller in diameter relative thereto is configured as a shelf portion 41*c* in the entire periphery.

A fuse support portion 43 is formed on an upper side from the bottom wall 42, which projects inward from a predetermined section of the second inner wall portion 41*b* in the circumferential direction and is offset upward from the bottom wall 42. The upper surface of the fuse support portion 43 is lower by the plate thickness of the elastic conductive plate 61 than the shelf portion 41*c*.

As shown in FIGS. 5A and 5B, opposing sections of the side wall 41 on a diameter line passing through the circumferential center of the fuse support portion 43 are formed by notching the first inner wall portion 41*a* in an upward side from the shelf portion 41*c* by a predetermined width.

An accommodation groove 48 is formed on the outer surface of the side wall 41 to extend downward to a point of reaching from the shelf portion 41*c* to the enlarged diameter ring portion 46, having the same predetermined width in the form of being connected to a notch 47 of the inner wall portion 41*a*.

Since the accommodation groove 48 accommodates a connecting wall 53, which will be described later, of the cover plate 50, the accommodation groove 48 has a radial depth in accordance with the plate thickness of the connecting wall 53 and is provided with a bottom wall having a cylindrical surface.

A stopper 44 is provided on the accommodation groove 48 to be in a groove width center and in a certain height position, and the stopper 44 has an inclined surface 44*a* formed in the upper side and an engagement surface 44*b* formed in a lower end surface connected to the inclined surface 44*a* to be perpendicular to an axial direction (refer also to FIG. 5E). A width of the stopper 44 is sized to be accommodated in an engagement hole 54, which will be described later, of the connecting wall 53.

A groove 49 is formed in the enlarged diameter ring portion 46, which is connected to the accommodation groove 48 and is narrower than the accommodation groove 48.

As shown in FIG. 5E, the bottom wall 42 is provided with a boss portion 90 at the back side, the boss portion 90 being adjacent closer to the center than the fuse support portion 43 and extending to the lower end (height of the lower end edge of the side wall 41), and a through slit 91 through which a terminal 6 passes is formed in the boss portion 90. In addition, a notch 92 is formed in a lower end portion of the boss portion 90 along the through slit 91.

An upper end opening periphery of the through slit 91 is formed as a concave portion 93 having a predetermined depth for avoiding interference with a bending portion of the terminal 6 and for thinning.

Arc-shaped fuse guides 94 are formed on the bottom wall 42 to oppose to each other for positioning the fuse 60. The terminal 6 on the bottom wall 42 extends between the fuse guides 94.

A screw boss 95 is, as shown in FIGS. 5C and 5D, formed on a diameter line perpendicular to a diameter line passing through the accommodation groove 48 to extend from one side wall 41 to the center vicinity along the lower surface of the bottom wall 42, and a screw hole 97 is opened to the outer surface of the side wall 41. A predetermined area in which the screw hole 97 is opened is configured as a plane portion 96.

As shown in FIGS. 5D and 5F, a holding wall 98 cutting across the screw boss 95 extends to the lower end in the same way as the boss portion 90 at a predetermined distance closer to the center from the opening side of the screw hole 97, and a guide groove 99 extends from the side wall 41 (enlarged diameter ring portion 46) in the opening side of the screw hole 97 to the holding wall 98 to guide the terminal 5.

FIGS. 6A to 6D show the cover plate 50.

The cover plate 50 comprises an upper wall 51 and connecting walls 53 that extend downward from opposing outer edges on a diameter line of the upper wall 51.

The upper wall 51 has an outer diameter matching an inner diameter of the first inner wall portion 41*a* of the fuse box 40, and has a hole 52 in the central part to make it possible for an electrode of the plug tip inserted in the case 2 to pass therethrough.

A rectangular engagement hole 54 is provided in the connecting wall 53, so that when the upper wall 51 is put down into the side wall 41 (first inner wall portion 41*a*) of the fuse box 40, the engagement hole 54 and the stopper 44 of the fuse box 40 are set to be fitted to each other in the accommodation groove 48.

A small diameter portion 56 having a predetermined height projects on the backside of the upper wall 51. The small diameter portion 56 is formed in a ring shape to be concentric with the hole 52.

A projection 55 is provided in the lower end of the connecting wall 53 to project outward (radial direction), and the upper surface of the projection 55 is configured as an engagement surface 55*a* perpendicular to an axial direction.

Figure 7:
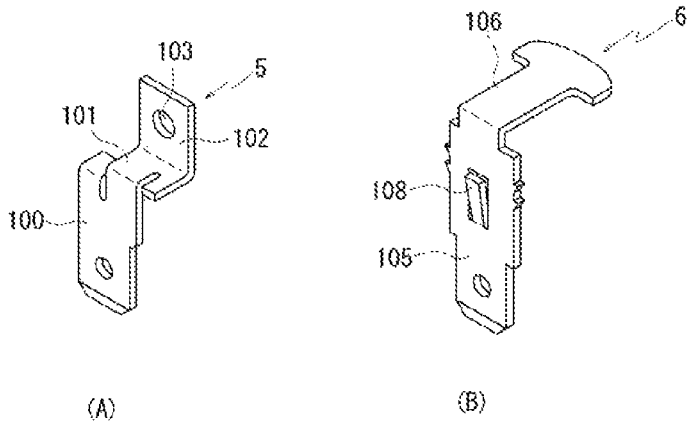
FIG. 7A is a perspective view showing a terminal according to the embodiment.
FIG. 7B is a perspective view showing a different terminal according to the embodiment.

In FIGS. 7A and 7B, the terminal 5 is folded in a crank shape to be formed, and a mounting portion 102 equipped with a screw hole 103 and a connector plug portion 100 for connection to an external connector are connected by a horizontal portion 101.

The terminal 6 is folded in an L-letter shape to be formed, and is composed of a connector plug portion 105 and a horizontal portion 106. The horizontal portion 106 forms a contact area that makes contact with the elastic conductive plate 61 of the fuse 60. A cut/raised stopper 108 is formed in the connector plug portion 105.

The terminal/fuse assembly 3 is assembled by fitting the terminal 6, the fuse 60, and the contact point disc 58 in the aforementioned fuse box 40 in the disposition order shown in FIG. 3.

The terminal 6 is prevented from dropping out from the fuse box 40 by such a manner that the connector plug portion 105 is inserted into the through slit 91 of the fuse box 40 from above and the cut/raised stop 108 having penetrated into the backside of the bottom wall 42 is engaged to the notch 92 of the boss portion 90. The horizontal portion 106 extends to the side wall 41 on the bottom wall 42 in a direction opposing the fuse support portion 43.

The fuse 60 is attached such that the thick width part 62*a* of the elastic conductive plate 61 is placed on the upper surface of the fuse support portion 43 in a state of directing the fuse body 65 upward, and the contact point disc 58 is overlapped over the fuse body 65.

Then, the upper wall 51 is fitted in the first inner wall portion 41*a* while putting the connecting wall 53 of the cover plate 50 along the accommodation groove 48 of the side wall 41 of the fuse box 40 for unification of the terminal/fuse assembly 3.

FIGS. 8A to 8C show an outside appearance of the united terminal/fuse assembly 3.

When the cover plate 50 will remove from the fuse box 40, the engagement surface 44*b* of the stopper 44 of the fuse box 40 is engaged to the lower edge of the engagement hole 54 in the connecting wall 53 to keep the coupling state.

In the housing 4 of the terminal/fuse assembly 3, the contact point disc 58 pressed by the small diameter portion 56 on the backside of the upper wall 51 is seated on the shelf portion 41, and at the same time, abuts against and pushes down the fuse body 65. As a result, the tongue piece 63 that supports the fuse body 65 is pushed down.

Thereby, a side of the ring portion 62 connected to the tongue piece 63 is pulled down, and, as shown in FIG. 2, the elastic conductive plate 61 is elastically deformed in an inclined state. In addition, particularly since the ring portion 62 is offset closer to the downward side than the tongue piece 63, the tongue piece 63 and, further, the ring portion 62 in the root periphery thereof are pushed on the horizontal portion 106 of the terminal 6 extending on the bottom wall 42. The above offset amount is very small, and therefore, the illustration is omitted in FIG. 2.

Here, the upper surface of the elastic conductive plate 61 (thick width part 62*a*) of the fuse 60 placed on the fuse support portion 43 is equal to a height of the shelf portion 41*c*, but since the press raised portion 64 is formed toward the upper side on the outer peripheral edge of the thick width part 62*a*, the elastic conductive plate 61 certainly keeps the contact state with the contact point disc 58 seated on the shelf portion 41*c*.

Also between the elastic conductive plate 61 and the terminal 6, since the press raised portion 64 is formed toward the downward side on the outer peripheral edge of the ring portion 62 to be connected to the tongue piece 63 and pulled downward, the certain contact therebetween is kept, not only the contact by the tongue piece 63.

In this way, an electrical conductive state between the contact point disc 58 and the terminal 6 is kept through the elastic conductive plate 61.

Next, FIGS. 9A to 9E show the outer case 10. The rim portion 13 of the outer case 10 is composed of a flange 14 for the power feed socket 1 to be seated on a hole edge of a mounting wall in a console box or the like for mounting the power feed socket 1 and to be formed in a position lower by a predetermined distance from an upper portion opening end of the cylindrical portion 11, and stop blocks 15 (15*a*, 15*b* and 15*c*) acting also as a design decoration and raised from the upper surface of the flange 14 closer to the upward position than the opening end.

The stop blocks are disposed in three locations divided equally in the circumferential direction, each having approximately ⅓ of the circumferential length. A radial outer side surface of the stop block 15 configures an outer vertical wall 17 extending upward along the outer peripheral edge of the flange 14, an inner side surface of the stop block 15 is connected to the outer periphery of the cylindrical portion 11, and an upper portion thereof from the opening end configures an inner vertical wall 18 extending with an arc surface coaxial with the outer side surface. Side vertical walls 19 at both ends of the stop block 15 in the circumferential direction are formed substantially in parallel to each other. Therefore, concave portions in the circumferential direction are formed between the plurality of the stop blocks 15.

In addition, the upper surface of the stop block 15 is formed as a curved surface that is gradually inclined downward from the inner diameter side to the outer diameter side, and the transition part to each of the inner vertical wall 18 and the outer vertical wall 17 is chamfered (R).

One stop block 15*a* is provided with a shaft hole 20 perpendicular to a diameter line passing through the circumferential center, and is formed as a hinge configuration section.

A gate-shaped frame portion 21 is formed on the outer peripheral surface of the cylindrical portion 11 between the two stop blocks 15*b* and 15*c* at the opposite side to the stop block 15*a* in the circumferential direction. A gate width (circumferential width) of the frame portion 21 is set larger than a width of a stopper 81 of a cap 70 to be described later.

It should be noted that the outer surface of the cylindrical portion 11 is provided with stoppers 23 in a position lower by a predetermined distance from the flange 14, and the stoppers 23 are engaged to the backside of the mounting wall to prevent the dropout of the power feed socket 1.

The outer surface of the cylindrical portion 11 is further provided with a guide track 24 formed thereon for regulating a rotating position of the power feed socket 1.

An inner bank (refer to FIG. 2) is formed on an upper end opening of the cylindrical portion 11 to hide an upper end edge of the inner case 30, and a water drainage hole 27 is formed at the lower part of the cylindrical portion 11.

Notches 25 are formed at the lower end of the cylindrical portion 11 to open to a downward side for engaging the projections 55 of the cover plate 50 thereto.

Figure 9:
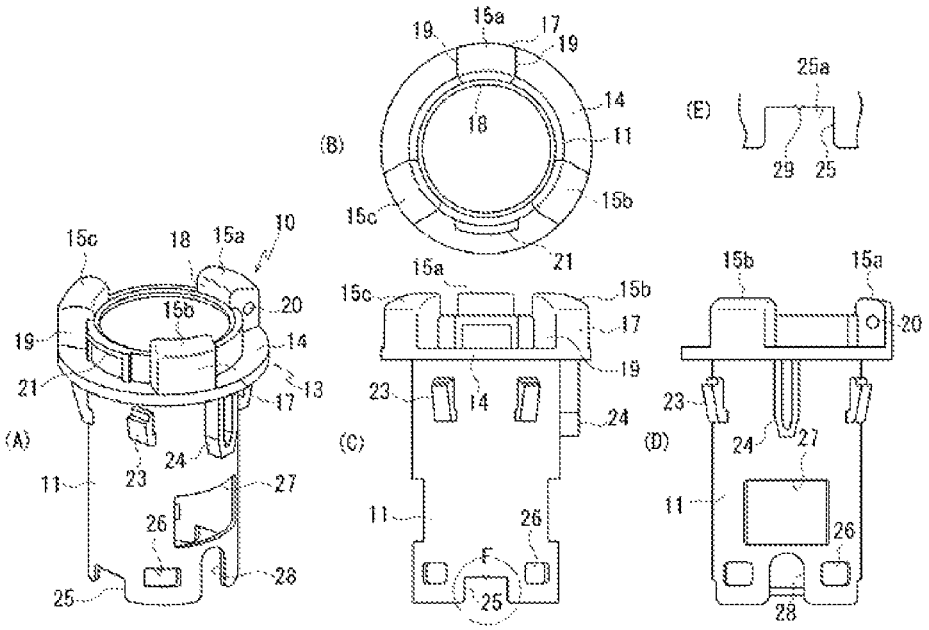
FIG. 9A is a perspective view showing an outer case according to the embodiment.
FIG. 9B is a top view showing the outer case.
FIG. 9C is a front view showing the outer case.
FIG. 9D is a side view showing the outer case.
FIG. 9E is an enlarged view showing an F part in FIG. 9C.

As enlarged in FIG. 9E for illustration, an elastic deformation portion 29 is provided on an upper edge 25*a* of the notch 25. The elastic deformation portion 29 is formed in a mountain shape with the top directed to the downward side, and has a base portion closer to an upper side than the upper edge 25*a* of the notch 25, and both sides thereof are formed as notches to the upper edge 25*a*. The top of the elastic deformation portion 29 projects by a predetermined amount closer to the downward side than the upper edge 25*a* of the notch 25.

In FIGS. 9A and 9D, denoted at 28 is the notch for inserting the screw 7 for fixing the terminal 5 to the inner case 30.

Figure 10:
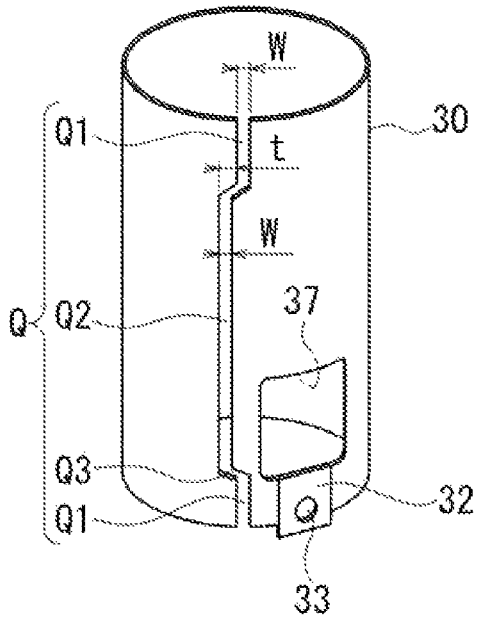
FIG. 10A is a perspective view showing an inner case according to the embodiment.
FIG. 10B is a partial enlarged view showing the inner case.
Figure 10:
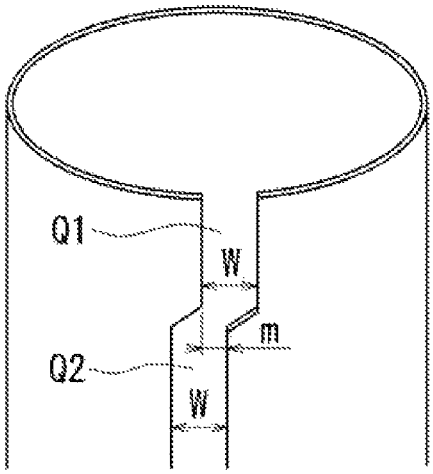

FIGS. 10A and 10B are perspective views each showing the inner case 30.

The inner case 30 is manufactured from a plate material by press bending work.

As shown in FIG. 10A, the inner case 30 has an outer diameter that is larger than an inner diameter of the outer case 10 in a free state, and is provided with an axial slit Q. The inner case 30 contracts in diameter in a direction of narrowing a slit width W (circumferential clearance of the slit) to be able to be inserted in the outer case 10.

That is, the slit width W is set in relation to the inner diameter of the outer case 10 and the outer diameter of the inner case 30 in a free state such that when the inner case 30 is compressed in a direction of narrowing the slit width W, the outer diameter of the inner case 30 is reduced to be smaller than the inner diameter of the outer case 10.

When the inner case 30 is released after being inserted in the outer case 10 in a reduced diameter state, the inner case 30 is expanded in diameter by elastic restoring force to make pressure contact with the inner wall of the outer case 10 and become in a fitting state having a predetermined inner diameter.

When the inner diameter of the inner case 30 is set to, for example, 21 mm in the fitting state, the slit width W may be the degree of 1.5 to 2.0 mm over the entire length.

The slit Q is composed of first linear portions Q1 each having a predetermined distance (for example, 5 mm) or less from each of both axial ends of the inner case 30, and a second linear portion Q2 that is offset in the circumferential direction from the first linear portions Q1 through inclined portions Q3 thereafter, and the slit width W including the inclined portion Q3 is set constant over the entire length.

In addition, as shown in FIG. 10B, an offset amount t between the first linear portion Q1 and the second linear portion Q2 is set such that an overlap m between a slit width of the first linear portion Q1 and a slit width of the second linear portion Q2 in a free state as viewed from the axis end is smaller than the plate thickness of the other fitting inner case (inner case 30). Preferably as shown in FIG. 10A, by setting the offset amount t to be larger than the slit width W, the second linear portion Q2 cannot be seen as viewed through the first linear portion Q1 from the axis end.

When the inner case 30 has the respective slits, it is unavoidable for the inner case 30 to be fitted into the slits of each other, but the fitting depth of each other is limited to a length range of the first linear portion Q1 of the axis end with constraint of the inclined portion Q3. Therefore, a length of the first linear portion Q1 is preferably shorter, and is made short to the degree of approximately ¼ of a length of the second linear portion Q2.

A water drainage hole 37 corresponding to the water drainage hole 27 of the outer case 10 is provided on the side surface of the inner case 30, and a flat portion 32 is formed in the lower end portion, which has a screw hole 33 to be configured as a mounting seat of the terminal 5.

The aforementioned assembling of the terminal/fuse assembly 3 is performed by being mounted to the inner case 30 before inserting the inner case 30 in the outer case 10.

First, the horizontal portion 101 of the terminal 5 is set along the guide groove 99 of the fuse box 40 and is inserted therein from side to seat the mounting portion 102 on a plane portion 96 to which the screw hole 97 is opened and make the connector portion 100 abut against the holding wall 98 for positioning. In addition, while the mounting portion 102 of the terminal 5 is positioned to the flat portion 32, the terminal/fuse assembly 3 is inserted in the inner case 30 in a free state from downward.

At this time, a clearance between each engagement stopper 45 and the side wall 41 receives the lower end edge of the inner case 30. In a state where the lower end edge of the inner case 30 is bottomed to the root of the engagement stopper 45, the screw 7 is screwed in the screw hole 97 of the fuse box 40 through the screw hole 103 of the mounting portion 102 of the terminal 5 from the screw hole 33 of the flat portion 32, and thereby, the terminal/fuse assembly 3 and the terminal 5 are coupled to the inner case 30 at the same time.

Mounting of the inner case 30 to the outer case 10 is performed such that while the inner case 30 connected to the terminal/fuse assembly 3 is deflected to position the mounting portion 102 (screw 7) of the terminal 5 to the notch 28, the inner case 30 is inserted in the cylindrical portion 11 from downward to be fitted therein.

Here, the engagement stopper 45 of the fuse box 40 enters into the cylindrical portion 11 with the cylindrical portion 11 elastically deformed, and thereafter, the engagement surface 45*b* of the engagement stopper 45 is engaged to the lower edge of the engagement hole 26 of the cylindrical portion 11. Thereby, the terminal/fuse assembly 3 (and the inner case 30) is positioned to restrict movement of the terminal/fuse assembly 3 in a dropout direction (downward) to the outer case 10.

On the other hand, the projection 55 provided in the connecting wall 53 in the cover plate 50 enters into the notch of the cylindrical portion 11 from downward and the engagement surface 55*a* of the projection 55 is engaged to the upper edge 25*a* of the notch 25 to restrict movement of the terminal/fuse assembly 3 to the outer case 10 in the entering direction (upward).

Therefore, the mounting position of the terminal/fuse assembly 3 to the case 2 is fixed.

Each of the water drainage holes 27 and 37 of the case 2 has a lower half portion that is opened to a position thereof making contact with the terminal/fuse assembly 3.

In a state where the terminal/fuse assembly 3 is mounted to the case 2, the electrode of the plug tip that is inserted in the case 2 passes through the hole 52 of the upper wall 51 in the cover plate 50 to be capable of being in contact with the contact point disc 58, and is electrically conductive to the terminal 6.

Here, in the notch 25 to which the projection 55 of the cover plate 50 is engaged, since the mountain-shaped top of the elastic deformation portion 29 formed in the upper edge 25*a* of the notch 25 projects closer to the downward side than the upper edge 25*a*, the engagement surface 55*a* of the projection 55 presses the elastic deformation portion 29 to be elastically deformed, and the connecting wall 53 is urged downward by reaction of the elastic deformation.

Thereby, the engagement stopper 45 is engaged to the lower edge of the engagement hole 26 in the cylindrical portion 11 to position and hold the fuse box 40, and on the other hand, the upper wall 51 of the cover plate 50 is held in a pressing state to the contact point disc 58. Therefore, even when manufacturing errors occur in components of the terminal/fuse assembly 3, for example, there is no occurrence of the event that the contact point disc 58 moves randomly in the housing 4 to generate abnormal noises.

FIGS. 11A to 11F show the cap 70.

Figure 11:
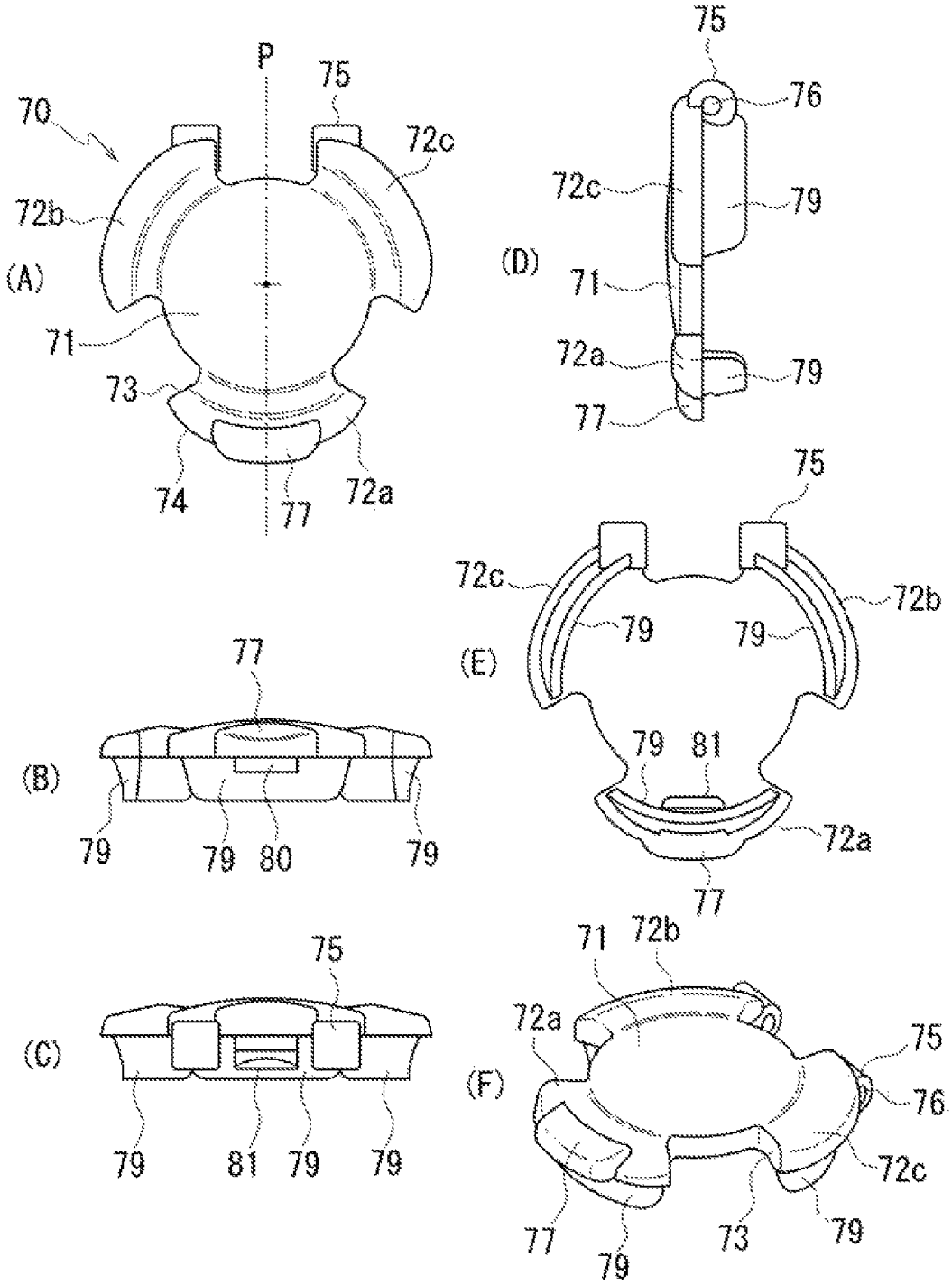
FIG. 11A is a plan view showing a cap according to the embodiment.
FIG. 11B is a front view showing the cap.
FIG. 11C is a rear view showing the cap.
FIG. 11D is a side view showing the cap.
FIG. 11E is a back view showing the cap.
FIG. 11F is a perspective view showing the cap.

The cap 70 is made of resin, and in a plan view of FIG. 11A, is composed of a main portion 71 having a circle as a basic shape, and enlarged diameter portions 72 (72*a*, 72*b*, and 72*c*) extending in three outward directions in a petal shape therefrom.

The main portion 71 has an upper surface center that is slightly swollen, and on the other hand, the backside thereof is formed as a flat surface extending to the enlarged diameter portion 72.

The enlarged diameter portion 72 is widened outward, and is disposed in such a manner as to fit in a circumferential clearance between the stop blocks 15 in the rim portion 13 of the outer case 10, and the enlarged diameter portions 72 are set such that a predetermined clearance S (refer to FIG. 1) can be generated between each of side edges 73 extending outward and each of side vertical walls 19 at both ends of the stop block 15 in the circumferential direction.

Two predetermined adjacent enlarged diameter portions 72*b* and 72*c* are provided with shaft support portions 75 each having a shaft hole 76 in a direction perpendicular to a diameter line P passing through an intermediate position of a clearance therebetween, and the shaft holes 76 are opened opposing on parallel planes including the respective side edges 73. A height of the shaft hole 76 is set slightly lower than that of backside of the main portion 71.

The other enlarged diameter portion 72 not provided with the shaft support portion 75 is provided with a finger hanging portion 77 projecting slightly outward over the outer periphery from the upper surface. The upper surface of the enlarged diameter portion 72 other than the finger hanging portion 77 is formed as a mountain-shape curve surface slightly swollen radially, and is chamfered along an outer peripheral edge 74. It should be noted that in FIG. 1, a curved line of the upper surface of the enlarged diameter portion 72 is omitted in illustration for simplification.

A curved surface gradually going down from an inner diameter side toward an outer diameter side on the upper surface of the stop block 15 in the rim portion 13 is formed corresponding to the outside from the top of the mountain-shaped curved surface, and the inside from the top of the mountain shape of the stop block 15 enters into the chamfered area connected to the inner vertical wall 18 in the inner diameter side.

An arc wall 79 having a predetermined height is formed on the backside of each of the enlarged diameter portions 72. The arc wall 79 is concentric with the main portion 71, and an inner diameter thereof has a larger diameter to have room to the opening end outer periphery of the cylindrical portion 11 in the outer case 10.

Particularly, the arc wall 79 of the enlarged diameter portion 72*a* provided with the finger hanging portion 77 is provided with a slit 80 circumferentially formed at the root to cause the arc wall 79 to be easily deflected in the radial direction, and a stopper 81 is formed on an inner wall thereof.

A hinge H (refer to FIG. 1) is formed by penetrating a hinge pin 38 through the respective shaft holes 76 and 20 of the shaft support portion 75 of the cap 70 and the stop block 15*a* of the rim portion 13, thereby to couple the cap 70 to the case 2 (outer case 10).

When the cap 70 is rotated around the hinge and the finger hanging portion 77-side is squeezed, the arc wall 79 is slightly deflected and the stopper 81 gets over the frame portion 21 of the cylindrical portion 11 to be engaged to the frame portion 21. In this way, as shown in FIG. 2, the cap 70 covers the opening end periphery of the cylindrical portion 11. In this state, as shown in FIG. 1, the lower edge of the arc wall 79 of the cap 70 is seated on or positioned near the flange 14 of the rim portion 13, and the upper surface of the enlarged diameter portion 72 is continuous with the upper surface of the stop block 15 in the rim portion 13.

The predetermined clearance S (refer to FIG. 1) between the side edge 73 of the enlarged diameter portion 72 and the side vertical wall 19 of the stop block 15 is preferably set to be possibly narrow as long as the side edge 73 and the side vertical wall 19 do not interference with each other during a rotation operation of the cap 70 from a position where the cap 70 is opened to a position where the cap 70 covers the opening end of the cylindrical portion 11.

In the power feed socket 1 configured as above, when the cap 70 is closed, the enlarged diameter portion 72 as the convex portion of the cap 70 and the concave portion between the stop blocks 15 of the rim portion 13 in the circumferential direction fit with each other.

Figure 12:
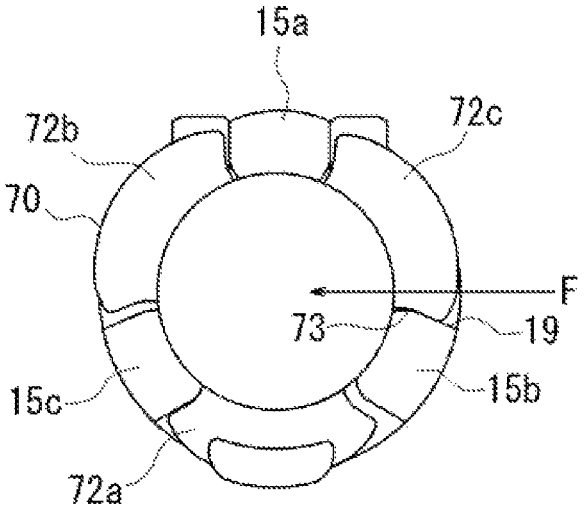
FIG. 12 is an explanatory diagram showing an operation of the power feed socket according to the embodiment.

Therefore, in a case where an external force F is effected in a lateral direction, since the cap 70 is configured to rotate on a basis of the hinge H portion including the stop block 15*a*, as shown in FIG. 12 the side edge 73 of the enlarged diameter portion 72*c* abuts against the side vertical wall 19 of the stop block 15*b*, and further, the side edge 73 of the enlarged diameter portion 72*a* abuts against the side vertical wall 19 of the stop block 15*c*, thus narrowing the clearance S between the side edge 73 and the side vertical wall 19. Reactions applied to the enlarged diameter portions 72*a* and 72*c* are directed along the respective surfaces, and each has high rigidity against the reaction. Therefore, the enlarged diameter portions 72*a* and 72*c*, and the main portion 71 are not deformed, which prevents the cap 70 from being displaced more than the extent of chinking the clearance S.

As a result, a rotation amount of the cap 70 is restricted to be small, and excessive torsion is not applied on the hinge H. Therefore, there occurs no damage of the hinge H portion.

At this time, since a gate width of the frame portion 21 in a side of the case 2 to which the stopper 81 of the cap 70 is engaged is large, the engagement is not released by the displacement of the cap 70 until the side edge 73 of the enlarged diameter portion 72*c* abuts against the side vertical wall 19 of each of the stop blocks 15*a* and 15*b*. Accordingly the cap 70 does not open either.

In addition, in a state where the cap 70 is closed, a flower pattern produced by surrounding the circular main portion 71 of the cap 70 with the enlarged diameter portions 72 and the stop blocks 15 of the rim portion 13 gives look high-class in view of design.

The engagement between the stopper 81 and the frame portion 21 is released by lifting the finger hanging portion 77, and it is possible to open the cap 70 easily.

in the present embodiment, the terminal/fuse assembly 3 corresponds to a contact point unit and the inner case 30 corresponds to a metallic case in the present invention.

The fuse box 40 corresponds to a second housing part, and the cover plate 50 corresponds to a first housing part. The hole 52 of the cover plate 50 corresponds to a window, and the engagement hole 54 of the connecting wall 53 and the stopper 44 of the accommodation groove 48 in the fuse box 40 configure a dropout stopping unit.

The terminal 6 corresponds to a first terminal, and the contact point disc 58 corresponds to a first contact point, and the terminal 5 corresponds to a second terminal. The upper edge 25*a* of the notch 25 corresponds to an engagement edge, and the engagement hole 26 of the cylindrical portion 11 corresponds to an engagement portion.

The present embodiment is configured as above, and the terminal/fuse assembly 3 comprises the fuse box 40 and the cover plate 50 each of which is made of resin and a non-conductive element, the cover plate 50 overlapping the fuse box 40 to form the housing 4, the terminal 6 that extends outside of the housing 4 through the bottom wall 42 of the fuse box 40 from the inside of the housing 4, the fuse 60 composed of the elastic conductive plate 61 and the fuse body 65 that overlaps over the elastic conductive plate 61 and is melted with overheating, the fuse 60 being disposed in the housing 4 in such a manner that a section of the elastic conductive plate 61 different from the tongue portion 63 as the overlapping portion thereof with the fuse body 65 is supported to the fuse support portion 43 in an upper position away from the terminal 6, and the contact point disc 58 that is disposed on the fuse 60 and is pressed from the cover plate 50, wherein the cover plate 50 is provided with the hole 52 for causing the contact point disc 58 to be exposed in such a manner that the electrode of the plug is contactable with the contact point disc 58, in the coupling state between the cover plate 58 and the fuse box 40, the contact point disc 58 presses the fuse body 65 to elastically deform the elastic conductive plate 61 and establish contact with the contact point disc 58 and the terminal 6, thereby causing conduction between the contact point disc 58 and the terminal 6, and when the fuse body 65 is melted, the elastic conductive plate 61 is elastically restored to be away from the terminal 6, thus causing non-conduction between the contact point disc 58 and the terminal 6.

Therefore, the contact point disc 58, the fuse 60 and the terminal 6 are united, which can be easily treated and can be assembled as one component in the case. In addition, since the housing 4 itself has an insulating function, the components such as the insulator, the insulating platform, and the power feed terminal needing to be manufactured as a special bolt, which lead to a high increase in cost, become unnecessary, and the assembled components can be used in common for many power feed sockets. Therefore, the power feed socket can be realized in a low cost.

The cover plate 50 comprises the upper wall 51 on which the contact point disc 58 is seated, and the connecting wall 53 extending from the outer peripheral edge of the upper wall 51 to the fuse box 40, wherein the hole 52 is formed in the upper wall 51. The fuse box 40 is formed in the bottomed cylindrical shape, wherein the side wall 41 is provided with the accommodation groove 48 that accommodates the connecting wall therein. The engagement hole 54 is provided in the connecting wall 53, and the stopper 44 is provided in the accommodation groove 48 to engage to the engagement hole 54 for dropout stop. Therefore, after attaching the terminal 6, the fuse 60 and the contact point disc 58 to the fuse box 40 in that order, when the cover plate 50 is only pressed into the fuse box 40 with the connecting wall 53 placed alongside of the accommodation groove 48, it is possible to obtain the terminal/fuse assembly 3 united by connecting the cover plate 50 and the fuse box 40 in the dropout stop state without an elaborate screw tightening work.

Since the outer peripheral shape of the housing 4 formed with the cover plate 50 and the fuse box 40 matches the cross section of the inner case 30, the terminal/fuse assembly 3 tends to be easily fitted in the inner case 30.

The terminal 6 is formed in an L-letter shape and includes the connector plug portion 105 and the horizontal portion 106, wherein the connector plug portion 105 penetrates through the through slit 91 provided in the bottom wall 42 of the fuse box 40, and the horizontal portion 106 is provided to be put along the bottom wall 42. Therefore, the contact part of the fuse 60 with the elastic conductive plate 61 is in a low position near the bottom wall 42, making it possible to lower the height of the housing 4 to be in a compact.

The elastic conductive plate 61 of the fuse 60 is composed of the ring portion 62, and tongue piece 63 extending inward from the ring portion 62, wherein the fuse body 65 made of resin and formed in a cylindrical shape is jointed onto the tongue piece 63, and a section of the ring portion 62 opposing the root of the tongue piece 63 across the ring center of the ring portion 62 is supported to the fuse support portion 43 upward of the bottom wall 42 in the fuse box 40. When the fuse body 65 is pressed from the contact point disc 58, the tongue piece 63 is displaced downward to be in contact with the horizontal portion 106 of the terminal 6.

That is, the elastic conductive plate 61 is folded back at the root of the tongue piece 63, and the distance between a support point by the fuse support portion 43 and a pressing point by the contact point disc 58 along the elastic conductive plate 61 is long. Therefore, a large change in height of the elastic conductive plate 61 can be obtained with no generation of large stress in the elastic conductive plate 61. Further, when the fuse body 65 is slightly melted with overheating, a change in height occurs immediately to eliminate the contact of the elastic conductive plate 61 with the terminal 6, and therefore, responsiveness of the elastic conductive plate 61 to the overheating is high.

Since the section of the ring portion 62 opposing the root of the tongue piece 63 across the ring center is configured as the thick width portion 62*a*, the thick width portion 62*a* becomes a guidepost for positioning the ring portion 62 to the fuse support portion 43 to facilitate the assembling work.

In the power feed socket 1, the terminal/fuse assembly 3 is fitted in the metallic inner case 30, the contact point disc 58 is configured as the first contact point that is exposed to the inside of the inner case 30 through the hole 52 of the upper wall 51 of the cover plate 50, and the inner case 30 is configured as the second contact point. Therefore, when the plug of the electrical product is inserted in the inner case 30, the electrode of the plug tip goes through the hole 52 to make contact with the contact point disc 58 and the electrode of the plug side surface makes contact with the inner case 30 to forma power source supply circuit to the electrical product having the above plug.

The power source circuit in the side of the power feed socket is formed only by the metallic inner case 30 and the united terminal/fuse assembly 3, and the configuration is simple.

In addition, since the fuse 60 of the terminal/fuse assembly 3 is disposed between the contact point disc 58 and the terminal 6 to be adjacent thereto, even in a case where heat is abnormally generated in the plug side of the electrical product or in a power source side of a vehicle, the fuse 60 is exposed to the plug side or power source side and at the same time, is exposed to the temperature rise thereof to melt the fuse body 65, thus break off the power source supply circuit with high responsiveness.

In addition, the power feed socket 1 further includes the plastic cylindrical outer case 10 and the inner case 30 disposed to overlap over an inside of the outer case 10, the projection 55 is provided on the connecting wall 53 of the cover plate 50 to project outward, the engagement stopper 45 is provided on the outer surface of the side wall 41 of the fuse box 40, and the outer case 10 is provided with the notch 25 provided with the upper edge 25*a* engaging to the projection 25 in the insert direction of the terminal/fuse assembly 3, and the engagement hole 26 to which the engagement stopper 45 is engaged in the dropout direction of the terminal/fuse assembly 3, whereby the terminal/fuse assembly 3 is positioned and fixed to the outer case 10 without using a particular connecting member such as a screw, thus facilitating the assembling work. In addition, in this case of having the outer case 10, since the outer case 10 holds the terminal/fuse assembly 3, the inner case 30 acts only as the contact point making contact with the plug of the electrical product, and is manufactured with a plate material by press bending process without deep drawing work, resulting in being formed in a low-cost, simple shape.

The elastic deformation portion 29 is provided in the upper edge 25*a* of the notch 25 in the outer case 10, and the connecting wall 53 is urged in a dropout direction with the reaction. Therefore, the fuse box 40 is restricted to move in the dropout direction by engagement between the engagement stopper 45 and the engagement hole 26 of the outer case 10. On the other hand, the cover plate 50 provided with the connecting wall 53 urges the fuse box 40 in the dropout direction, so that the cover plate 50 and the fuse box 40 overlap with each other in a pressing state. As a result, there is no occurrence of clattering between the cover plate 50 and the fuse box 40, and there is no occurrence of the event that the contact point disc 58 or the fuse 60 moves randomly in the housing 4 to generate abnormal noises.

The terminal 5 together with the terminal/fuse assembly 3 are coupled to the inner case 30 through joint tightening of a screw. Therefore, one screw performs the coupling between the inner case 30 and the terminal 5, and at the same time, positioning and fixing of the inner case 30 to the outer case 10 through the terminal/fuse assembly 3, thus achieving simplification of the structure and cost reduction.

It should be noted that in the present embodiment, the engagement stopper 45 provided in the fuse box 40 is engaged to the engagement hole 26 of the outer case 10 to position the fuse box 40 in the dropout direction and to hold the lower end of the inner case 30. However, the positioning of the fuse box 40 (terminal/fuse assembly 3) and the holding of the inner case 30 may be individually performed by different stoppers.

Or the holding of the inner case 30 can be performed by forming an inner bank for dropout stopper on the inner wall near the upper/lower opening end of the cylindrical portion 11 of the outer case 10.

in the present embodiment, the flange 14 for seating the power feed socket 1 on the hole edge of the mounting wall for mount is formed to be integral with the cylindrical portion 11 incorporating the terminal/fuse assembly 3 therein, but a section for seating the power feed socket 1 on the hole edge of the mounting wall and a cylindrical portion may be formed individually to form an assembly thereof.

The present invention is convenient and effective, particularly in a case of being applied to a power feed socket installed in a vehicle or the like.

While only the selected embodiment has been chosen to illustrate the present invention, it will be apparent to those skilled in the art from this disclosure that various changes and modifications can be made therein without departing from the scope of the invention as defined in the appended claims. Furthermore, the foregoing description of the embodiment according to the present invention is provided for illustration only, and not for the purpose of limiting the invention as defined by the appended claims and their equivalents.

DESCRIPTION OF THE CODES

1 Power feed socket
2 Case
3 terminal/fuse assembly (Contact point unit)
4 Housing
5 Terminal (Second terminal)
6 Terminal (First terminal)
7 Screw
10 Outer case
11 Cylindrical portion
12 Inner bank
13 Rim portion
14 Flange
15*a*, 15*b*, 15*c* Stop block
17 Outer vertical wall
18 Inner vertical wall
19 Side vertical wall
20 Shaft hole
21 Frame portion
23 Stopper
24 Guide track
25 Notch
25*a* Upper edge (Engagement edge)
26 Engagement hole (Engagement portion)
27, 37 Water drainage hole
28 Notch
29 Elastic deformation portion
30 Inner case (Metallic case)
38 Hinge pin
40 Fuse box (Second housing part)
41 Side wall
41*a* First inner wall portion
41*b* Second inner wall portion
41*c* Shelf portion
42 Bottom wall
43 Fuse support portion
44 Stopper
44*a* Inclined surface
44*b* Engagement surface
45 Engagement stopper
45*a* Inclined surface
45*b* Engagement surface
46 Enlarged diameter ring portion
47 Notch
48 Accommodation groove
49 Groove
50 Cover plate (First housing part)
51 Upper wall
52 Hole (Window)
53 Connecting wall
54 Engagement hole
55 Projection
55*a* Engagement surface

56 Small diameter portion
58 Contact point disc (First contact point)
60 Fuse
61 Elastic conductive plate
62 Ring portion
62*a* Thick width portion
63 Tongue piece
64 Press raised portion
65 Fuse body
70 cap
71 Main portion
72*a*, 72*b*, 72*c* Enlarged diameter portion
73 Side edge
74 Outer peripheral edge
75 Shaft support portion
76 Shaft hole
77 Finger hanging portion
79 Arc wall
80 Slit
81 Stopper
90 Boss portion
91 Through slit
92 Notch
93 Concave portion
94 Fuse guide
95 Screw boss
96 Plane portion
97 Screw hole
98 Holding wall
99 Guide groove
100, 105 Connector plug portion
101, 106 Horizontal portion
102 Mounting portion
103 Screw hole
108 Cut raised stopper
H Hinge

What is claimed is:

1. A contact point unit used in a power feed socket supplying power to a plug of an electrical product by inserting the plug into a case comprising:

a first housing part made of resin;

a second housing part made of resin that the first housing part overlaps to form a housing;

a first terminal that extends outside of the housing through a bottom wall of the second housing part from the inside of the housing;

a fuse comprising an elastic conductive plate and a fuse body that overlaps over the elastic conductive plate and is melted with overheating, the fuse being disposed in the housing in such a manner that a section of the elastic conductive plate different from an overlapping portion thereof with the fuse body is supported to an upper position separated from the first terminal; and a first contact point that is disposed on the fuse and is pressed from the first housing part, wherein the first housing part is provided with a window for exposing the first contact point in such a manner that an electrode of the plug is contactable with the first contact point, in a coupling state between the first housing part and the second housing part, the first contact point presses the fuse body to elastically deform the elastic conductive plate, which makes contact with the first contact point and the first terminal, thereby causing conduction between the first contact point and the first terminal, and when the fuse body is melted, the elastic conductive plate is elastically restored to be away from the first terminal, thus causing non-conduction between the first contact point and the first terminal.

2. The contact point unit according to claim 1, wherein the first housing part comprises an upper wall on which the first contact point is seated, and a plurality of connecting walls extending from an outer peripheral edge of the upper wall to the second housing part, the window is formed in the upper wall, the second housing part is formed in the bottomed cylindrical shape, of which a side wall is provided with an accommodation groove that accommodates the connecting wall therein, a dropout stopper is provided between the connecting wall and the accommodation groove, and an outer peripheral shape of the housing matches a transverse section of the case.

3. The contact point unit according to claim 2, wherein the first terminal is formed in an L-letter shape and includes a connector plug portion and a horizontal portion, wherein the connector plug portion penetrates through a through slit provided in the bottom wall of the second housing part, and the horizontal portion is provided on and along the bottom wall.

4. The contact point unit according to claim 3, wherein the elastic conductive plate of the fuse comprises a ring portion, and a tongue piece extending inward from the ring portion, the fuse body made of resin and formed in a cylindrical shape is jointed onto the tongue piece, a section of the ring portion opposing the root of the tongue piece across the ring center of the ring portion is supported to a position upward from the bottom wall in the second housing portion, and when the fuse body is pressed from the first contact point, a side of the ring portion to which the tongue piece is connected is displaced downward to be in contact with the horizontal portion of the first terminal.

5. The contact point unit according to claim 4, wherein a section of the ring portion opposing the root of the tongue piece across the ring center is configured as a thick width portion.

6. A power feed socket including the contact point unit according to claim 2 that is fitted in a metallic case, wherein the first contact point is exposed to an inside of the metallic case through the window of the upper wall of the first housing part, and the metallic case is configured as a second contact point.

7. The power feed socket according to claim 6, further comprising:

a plastic cylindrical outer case; and an inner case configured as the metallic case disposed to overlap over an inside of the outer case, wherein a projection is provided on the connecting wall of the first housing part to project outward, an engagement stopper is provided on an outer surface of a side wall of the second housing part, and the outer case is provided with a notch provided with an upper edge engaging to the projection in the insert direction of the contact point unit, and an engagement portion, to which the engagement stopper is engaged, in a dropout direction of the contact point unit.

8. The power feed socket according to claim 7, wherein an elastic deformation portion is provided in an engagement edge of the notch, and the connecting wall is urged in the dropout direction with the reaction.

9. The contact point unit according to claim 6, wherein a second terminal together with the contact point unit is coupled to the metallic case by joint tightening of a screw.

* * * * *